US009334795B2

(12) United States Patent
Thomassin et al.

(10) Patent No.: US 9,334,795 B2
(45) Date of Patent: May 10, 2016

(54) ROTARY INTERNAL COMBUSTION ENGINE WITH STATIC OIL SEAL

(71) Applicant: Pratt & Whitney Canada Corp., Longueuil (CA)

(72) Inventors: Jean Thomassin, Ste-Julie (CA); Jean-Gabriel Gauvreau, Brossard (CA); David Gagnon-Martin, Longueuil (CA); Bruno Villeneuve, Boucherville (CA)

(73) Assignee: PRATT & WHITNEY CANADA CORP., Longueuil, Quebec ( * ) Notice: Subject to any disclaimer, the term of this patent is extended or adjusted under 35 U.S.C. 154(b) by 212 days.

(21) Appl. No.: 13/960,045

(22) Filed: Aug. 6, 2013

(65) Prior Publication Data

US 2015/0040855 A1 Feb. 12, 2015

(51) Int. Cl.

*F04C 2/00* (2006.01)
*F02B 55/08* (2006.01)
*F02B 53/00* (2006.01)

(52) U.S. Cl.

CPC ..... *F02B 55/08* (2013.01); *F02B 2053/005* (2013.01)

(58) Field of Classification Search

CPC ..... F01C 19/00; F01C 19/10; F01C 19/12; F01C 19/125; F01C 21/005; F01C 21/08; F02B 55/08; F02B 2053/005

USPC ..... 123/218, 241–242; 418/116–117, 418/119–121, 125–129, 133, 140, 144, 418/61.1, 61.2; 277/348, 358, 368–369, 277/370

See application file for complete search history.

(56) References Cited

U.S. PATENT DOCUMENTS

| | | | | | |
|---|---|---|---|---|---|
| 834,819 | A | * | 10/1906 | Leopold | 418/125 |
| 1,482,628 | A | * | 2/1924 | Bullington | 418/36 |
| 1,721,855 | A | * | 7/1929 | Burrow | 123/228 |
| 1,994,858 | A | * | 3/1935 | Lack et al. | 277/365 |
| 3,261,542 | A | * | 7/1966 | Jones | 418/61.2 |
| 3,400,939 | A | * | 9/1968 | Jones | 277/357 |
| 3,655,302 | A | * | 4/1972 | Hermes et al. | 418/61.2 |
| 3,918,858 | A | | 11/1975 | Imaizumi | |
| 3,945,776 | A | | 3/1976 | Morita | |
| 3,969,049 | A | * | 7/1976 | Hermes et al. | 418/91 |
| 3,994,266 | A | | 11/1976 | Jones | |
| 4,120,622 | A | | 10/1978 | Goloff et al. | |
| 4,643,438 | A | | 2/1987 | Klusowski et al. | |

(Continued)

FOREIGN PATENT DOCUMENTS

GB 1046504 10/1966

*Primary Examiner* — Jorge Pereiro
*Assistant Examiner* — Jason T Newton
(74) *Attorney, Agent, or Firm* — Norton Rose Fulbright Canada

(57) ABSTRACT

A stator for a rotary internal combustion engine, with a body having an internal cavity. Each end wall has a scavenging cavity defined therein in fluid communication with the internal cavity through a respective scavenging opening extending through the inner surface thereof, and at least one annular oil seal groove defined in the inner surface thereof concentric with the central bore and located radially outwardly of the scavenging opening. At least one annular oil seal is received in each groove and protrudes from the end wall into the internal cavity for sealing engagement with a surface of a rotor of the engine, each seal being biased axially away from the end wall. A rotary internal combustion engine and a method of limiting radially outwardly directed oil leaks in a rotary engine are also disclosed.

22 Claims, 3 Drawing Sheets

(56) References Cited

U.S. PATENT DOCUMENTS

| | | | | |
|---|---|---|---|---|
| 5,755,197 | A | 5/1998 | Oplt | |
| 6,672,263 | B2 | 1/2004 | Vallejos | |
| 7,234,924 | B2 * | 6/2007 | Baier et al. | 418/61.2 |
| 8,225,767 | B2 | 7/2012 | Tinney | |
| 2005/0186102 | A1 * | 8/2005 | Baier et al. | 418/61.1 |

* cited by examiner

ROTARY INTERNAL COMBUSTION ENGINE WITH STATIC OIL SEAL

TECHNICAL FIELD

The application relates generally to rotary internal combustion engines, and more particularly, to an oil seal arrangement for such engines.

BACKGROUND OF THE ART

Rotary engines such as the ones known as Wankel engines use the eccentric rotation of a piston to convert pressure into a rotating motion, instead of using reciprocating pistons. In these engines, the rotor includes a number of apex portions which remain in contact with a peripheral wall of the internal cavity of the engine throughout the rotational motion of the rotor.

One or more oil annular seals are typically provided in each end face of the rotor around the eccentric portion of the rotor shaft and are biased against the housing wall, to prevent oil from entering the combustion area. The oil is usually scavenged through an annular opening in the housing wall which must be sufficiently small to remain radially inwardly of the perimeter of the oil seals during rotation of the rotor. The load on the seal due to the oil pressure caused by the relative difficulty in evacuating the scavenged oil through the opening can become significant, increasing the risk of leaks.

SUMMARY

In one aspect, there is provided a stator for a rotary internal combustion engine, the stator comprising: a body having two axially spaced apart end walls and a peripheral wall extending between the end walls, with inner surfaces of the end walls and of the peripheral wall enclosing an internal cavity configured for receiving a rotor, the body further having an axial central bore defined therethrough and through the end walls for receiving a shaft of the rotor therein, each end wall having a scavenging cavity defined therein in fluid communication with the internal cavity through a respective scavenging opening extending through the inner surface thereof, each of the end walls having at least one annular oil seal groove defined in the inner surface thereof concentric with the central bore and located radially outwardly of the scavenging opening; and at least one annular oil seal received in each groove and protruding from the end wall into the internal cavity for sealing engagement with a surface of a rotor of the engine, each seal being biased axially away from the end wall.

In another aspect, there is provided a rotary internal combustion engine comprising: an outer body having two axially spaced apart end walls and a peripheral wall extending between the end walls, with inner surfaces of the end walls and of the peripheral wall enclosing an internal cavity, the outer body having an axial central bore defined therethrough and through the end walls rotationally receiving a shaft therein; a rotor body received in the internal cavity, the rotor body having two axially spaced apart end faces each extending in proximity of the inner surface of a respective one of the end walls, and a peripheral face extending between the end faces and defining circumferentially spaced apex portions, the rotor body being engaged to an eccentric member of the shaft to rotate within the cavity with each of the apex portions remaining adjacent the inner surface of the peripheral wall; each of the end walls of the outer body having a scavenging cavity defined therein in fluid communication with the internal cavity through a respective scavenging opening extending through the inner surface thereof, each of the end walls having at least one annular oil seal groove defined in the inner surface thereof concentric with the central bore and located radially outwardly of the scavenging opening and of a path of the eccentric member during rotation thereof; and at least one annular seal received in each seal groove and sealingly engaged with an adjacent one of the end faces of the rotor, each seal being axially biased against the adjacent one of the end faces.

In a further aspect, there is provided a method of limiting radially outwardly directed oil leaks between an end face of a rotor of a rotary engine and an inner surface of an adjacent end wall of an outer body of the engine, the method comprising: rotating the rotor within the outer body while moving a central axis of the rotor; blocking a radially outwardly directed flow of oil by scraping an annular wiper seal extending from the inner surface of the end wall against the rotating end face of the rotor; directing the oil through a scavenging opening defined in the inner surface of the end wall and located radially inwardly of the wiper seal; and scavenging the oil in a scavenging cavity of the end wall communicating with the scavenging opening.

DESCRIPTION OF THE DRAWINGS

Reference is now made to the accompanying figures in which.

DETAILED DESCRIPTION

Figure 1:
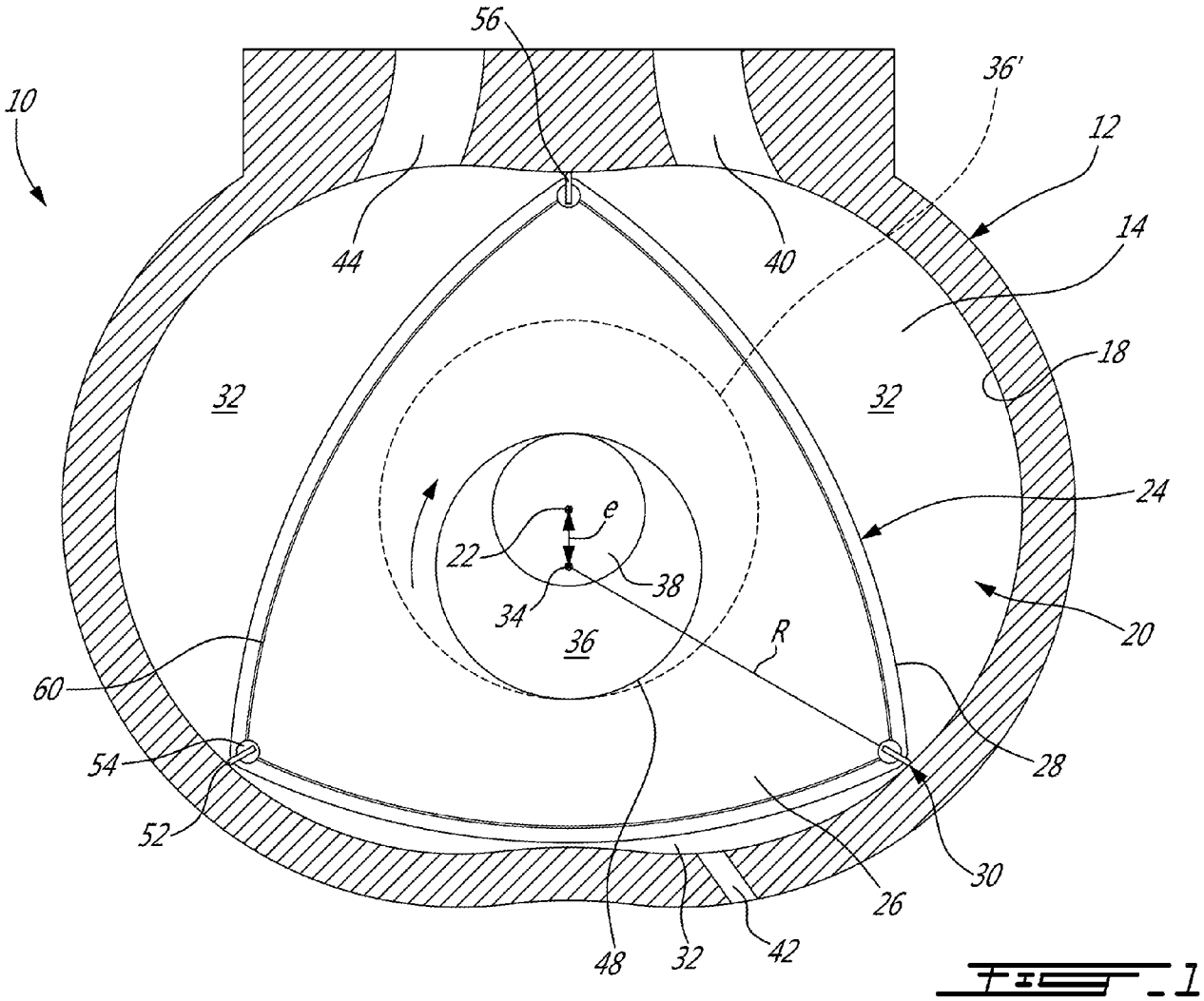
FIG. 1 is a schematic cross-sectional view of a rotary internal combustion engine in accordance with a particular embodiment.

Referring to FIG. 1, a rotary internal combustion engine 10 known as a Wankel engine is schematically and partially shown. In a particular embodiment, the rotary engine 10 is used in a compound cycle engine system such as described in Lents et al.'s U.S. Pat. No. 7,753,036 issued Jul. 13, 2010 or as described in Julien et al.'s U.S. Pat. No. 7,775,044 issued Aug. 17, 2010, the entire contents of both of which are incorporated by reference herein. The compound cycle engine system may be used as a prime mover engine, such as on an aircraft or other vehicle, or in any other suitable application. In any event, in such a system, air is compressed by a compressor before entering the Wankel engine, and the engine drives one or more turbine(s) of the compound engine. In another embodiment, the rotary engine 10 is used without a turbocharger, with air at atmospheric pressure.

Although described herein as a Wankel engine, it is understood that the engine 10 can alternately be any other appropriate type of rotary engine, including other types of eccentric rotary engines.

The engine 10 comprises a stator or outer body 12 having axially-spaced end walls 14 with a peripheral wall 18 extending therebetween, such that the inner surfaces of the walls 14, 18 enclose an internal cavity 20. The inner surface of the peripheral wall 18 has a profile defining two lobes in the cavity 20, such that the cavity has a shape which is preferably an epitrochoid.

An inner body or rotor 24 is received within the cavity 20. The rotor 24 has axially spaced end faces 26 adjacent to the outer body end walls 14, and a peripheral face 28 extending therebetween. The peripheral face 28 defines three circumferentially-spaced apex portions 30, and a generally triangular profile with outwardly arched sides. The apex portions 30 are in sealing engagement with the inner surface of the peripheral wall 18 to form three working chambers 32 between the inner rotor 24 and outer body 12. The geometrical axis 34 of the rotor 24 is offset from and parallel to the axis 22 of the cavity 20.

The outer body 12 is stationary while the rotor 24 is journaled on an eccentric member 36 of a shaft 38, the shaft 38 being co-axial with the geometrical axis 22 of the cavity 20 and the eccentric member 36 being coaxial with the geometrical axis 34 of the rotor 24. The rotor 24 includes a phasing gear 56 (see FIG. 2) around and in proximity of the eccentric member 36 of the shaft 38, which is meshed with a fixed stator phasing gear 58 (see FIG. 2) secured to the outer body 12 co-axially with the shaft 38. The shaft 38 rotates three times for each complete rotation of the rotor 24 as it moves around the internal cavity 20. Upon rotation of the rotor 24 relative to the outer body 12 the working chambers 32 vary in volume.

Still referring to FIG. 1, at least one intake port 40 is defined through the peripheral wall 18 as shown, or alternately through one of the end walls 14, admitting air (atmospheric or compressed) into one of the working chambers 32. At least one exhaust port 44 is defined through the peripheral wall 18 as shown, or alternately through one of the end walls 14, for discharge of the exhaust gases from the working chambers 32. The intake and exhaust ports 40, 44 are positioned relative to each other and relative to an ignition mechanism and fuel injectors such that during each rotation of the rotor 24, each chamber 32 moves around the cavity 20 with a variable volume to undergo the four phases of intake, compression, expansion and exhaust, these phases being similar to the strokes in a reciprocating-type internal combustion engine having a four-stroke cycle.

In a particular embodiment, these ports 40, 44 are arranged such that the rotary engine 10 operates under the principle of the Miller or Atkinson cycle, with its volumetric compression ratio lower than its volumetric expansion ratio. In another embodiment, the ports 40, 44 are arranged such that the volumetric compression and expansion ratios are equal or similar to one another.

A passage 42 is also provided through the peripheral wall 18 for receiving a main fuel injector (not shown). In one embodiment, an additional passage is defined through the peripheral wall for receiving an ignition mechanism; another passage may also be defined for receiving a pilot fuel injector. Alternately, an additional passage is defined in communication with a pilot subchamber communicating with a pilot injector and an ignition mechanism, for providing a pilot injection.

The working chambers 32 are sealed. Each rotor apex portion 30 has at least one apex seal 52 extending from one end face 26 to the other and protruding radially from the peripheral face 28. Each apex seal 52 is biased radially outwardly against the peripheral wall 18 through a respective spring. An end seal 54 engages each end of each apex seal 52, and is biased against the respective end wall 14 through a suitable spring. Each end face 26 of the rotor 24 has at least one arc-shaped face seal 60 running from each apex portion 30 to each adjacent apex portion 30, adjacent to but inwardly of the rotor periphery throughout its length. A spring urges each face seal 60 axially outwardly so that the face seal 60 projects axially away from the adjacent rotor end face 26 into sealing engagement with the adjacent end wall 14 of the cavity. Each face seal 60 is in sealing engagement with the end seal 54 adjacent each end thereof.

At least one oil seal is provided to seal against radially outwardly directed oil leaks into the working chambers 32, from oil used for lubrication and/or cooling of the rotor and other rotating elements located radially inwardly of the chambers 32, as will be further detailed below. In the present specification including claims, the term "oil" is intended to include any appropriate type of fluid which may be used for lubrication and/or cooling in the engine 10.

Figure 2:
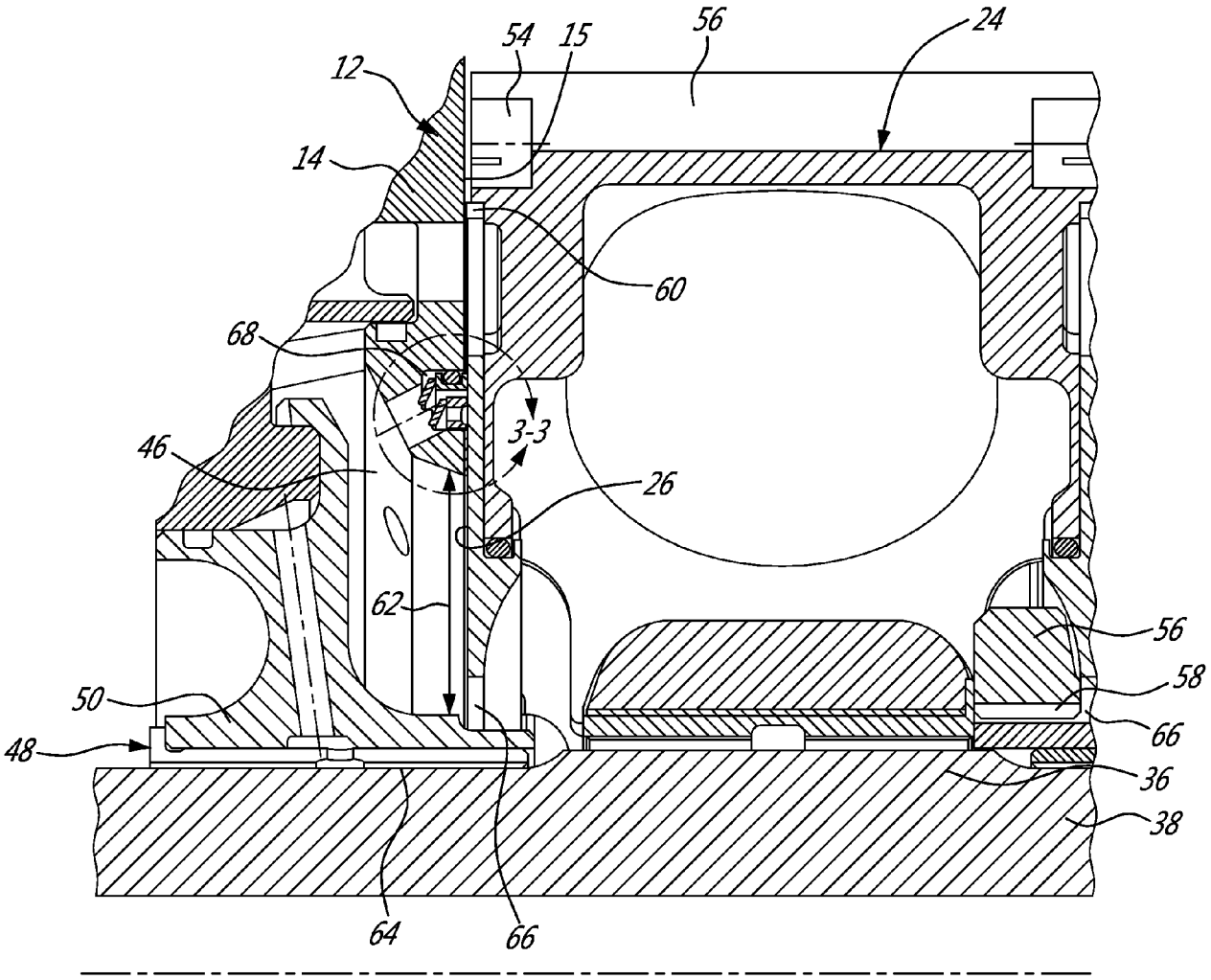
FIG. 2 is a cross-sectional view of part of a rotor and of a stator of a rotary internal combustion engine such as shown in FIG. 1, in accordance with a particular embodiment.

Referring to FIG. 2, each end wall 14 has a scavenging cavity 46 defined therein (only one of which being shown). Each scavenging cavity 46 is in fluid communication with an oil tank (not shown) of an appropriate oil circulation system. Each scavenging cavity 46 also communicates with the internal cavity 20 through an annular scavenging opening 62 defined through the inner surface 15 of the end wall 14. Each scavenging opening 62 is located around the body's central bore 64 for receiving the shaft 38, which is defined through the end walls 14 by the shaft bearing 48. In the embodiment shown, the oil used for cooling the rotor 24 and lubricating the gears 56, 58 exit the rotor 24 through an annular opening 66 defined in each rotor end face 26, and is received in the scavenging cavity 46 through the scavenging openings 62 which remain in alignment with the respective rotor annular opening 66 throughout the rotation of the rotor 24. The bearing support 50 supporting the bearing 48 extends in the scavenging cavity 46 and a fluid communication is defined therethrough for circulating oil from the bearing 48 to the scavenging cavity 46 without circulating through the scavenging opening 62. Additional oil also circulates from the bearing 48 through the scavenging opening 62. Other configurations are also possible.

Each end wall 14 also includes one (as shown) or more annular seal groove(s) 68 defined in its inner surface 15, concentric with the central bore 64 and located radially outwardly of the scavenging opening 62. Each seal groove 68 receives at least one annular oil seal, with each oil seal protruding from the end wall 14. Each oil seal and is biased axially against the end face 26 to be in sealing engagement therewith, to block oil leakage between the end face 26 and the end wall 14 in the radially outwardly direction.

Figure 3A:
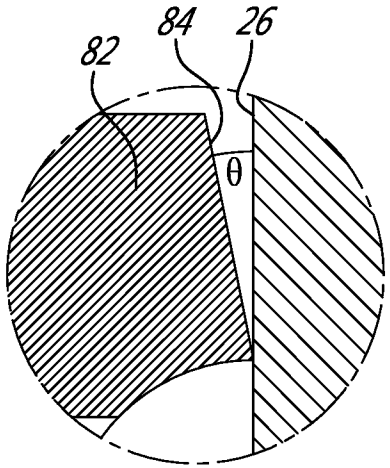
FIG. 3A is an enlarged cross-sectional view of portion 3A of FIG. 3, showing part of one of the oil seals.
Figure 3:
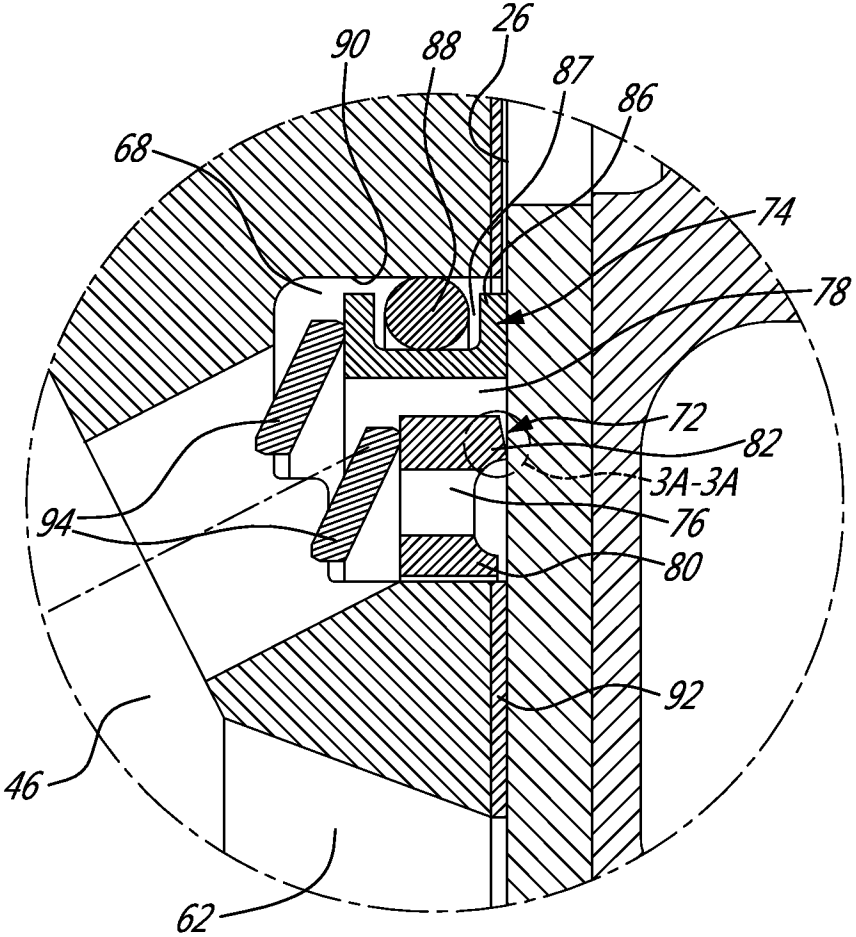
FIG. 3 is an enlarged cross-sectional view of the oil seals of the part of the rotor and stator of FIG. 2.

Referring to FIG. 3, in the particular embodiment shown, the seal groove 68 receives a first annular seal 72 and a second annular seal 74 concentric with and having a greater diameter than that of the first seal 72. Alternate configurations are also possible, including, but not limited to, each seal 72, 74 being provided in a separate groove and a single groove and seal being provided.

In the embodiment shown, the two seals 72, 74 have different configurations from one another. The first, radially inward seal 72 is defined as a wiper or scraper seal, with two axially extending lips 80, 82. The second lip 82 is located radially outwardly of the first lip 80 and extends further away from the end wall 14, such that the second lip 82 is in sealing engagement with the rotor end face 26 while a gap is defined between the rotor end face 26 and the first lip 80 through which the oil can circulate. As shown in FIG. 3A, the second lip 82 has a radial contact surface 84 which is angled with respect to the radial direction of the cavity 20, and as such angled with respect to the rotor end face 26. In a particular embodiment, the angle θ is from about 3 to about 6 degrees. In a particular embodiment, the first seal 72 is made of an adequate metal, for example steel, cast iron or an adequate type of super alloy. Other configurations are also possible.

In the embodiment shown, a fluid communication between the seal groove 68 and the scavenging cavity 46 is defined through an axial opening 76 of the first seal 72 located between the two lips 80, 82. As such, oil may flow between the inner surface 15 of the end wall 14 and the rotor end face 26, through the gap between the first lip 80 and the rotor end face 26 and through the axial opening 76. Another fluid communication between the seal groove 68 and the scavenging cavity 46 is defined between the first and second seals 72, 74, through a radial gap 78 therebetween.

In the embodiment shown, the second, radially outward seal 74 is configured to seal against gas leaks from the chambers 32 in the radially inward direction as well as against oil leaks in the radially outward direction into the chambers 32. In the embodiment shown, the second seal 74 includes a seal ring 86 having a U-shaped cross-section defining an annular opening 87 in the radially outward face of the ring 86. The seal ring 86 is made of an adequate metal, for example steel, cast iron or an adequate type of super alloy. An annular compressible sealing element 88, for example an O-ring, is received in the annular opening 87 and protrudes radially outwardly therefrom. The compressible sealing element 88 is made of a more flexible material than the seal ring 86, for example rubber or any adequate type of polymer such as a perfluoroelastomer. The second seal 74 is biased axially such that the seal ring 86 is in sealing engagement with the end face 26 and radially outwardly such that the compressible sealing element 88 is in sealing engagement with an axially extending surface 90 of the stator body 12, which extends from and is adjacent to the end wall 14.

In the embodiment shown, each seal 72, 74 is biased away from the end wall 14 by a respective spring member 94, for example a bevel spring, which extends across the communication between the seal groove 68 and the scavenging cavity 46. The spring members 94 are sized and positioned to allow adequate fluid communication therearound. In an alternate embodiment, each seal may be biased using any other appropriate type of biasing member, or may be pressure loaded.

In use and in the particular embodiment shown, radially outwardly directed oil leaks between each rotor end face 26 and the inner surface 15 of the adjacent end wall 14 are limited by scraping the first seal 72 against the rotating end face 26, and directing the oil through the scavenging opening 62. The second seal 74 further blocks the oil which has leaked radially outwardly of the first seal 72 through its sealing engagement with the rotating end face 26. The second seal 74 additionally limits radially inwardly directed gas leaks between the end face 26 and the inner surface 15 of the end wall 14 through its sealing engagement with the corresponding inner wall surface 90.

Alternately, a single oil seal may extend from each of the end faces 26. In a particular embodiment, this single seal may additionally provide sealing against radially inwardly directed gas leaks. The configuration of each seal may also vary, with the configuration shown being provided as an example only.

Referring back to FIG. 1, in a particular embodiment, to ensure sufficient space is available for placement of the oil seal groove(s) 68 radially inwardly of the chambers 32 and radially outwardly of the path 36' of the eccentric member 36, a ratio R/e of the engine is at least 7, where R corresponds to the radius of the rotor 24 defined as the radial distance between its central axis 34 and the tip of one of the apex portions 30, and e corresponds to the eccentricity defined as the radial distance between the central axis 22 of the shaft 38 (and of the cavity 20) and the central axis 34 of the eccentric member 36 (and of the rotor 24). In a particular embodiment, the ratio R/e is at least 7.5; in a particular embodiment, the ratio R/e is about 7.75. In a particular embodiment, a larger ratio R/e facilitates placement of the oil seal groove(s).

In a particular embodiment, the rotor 24 is made of titanium and has a ratio R/e of at least 7; preferably, at least 7.5; more preferably, about 7.75. In a particular embodiment, the use of titanium or any other adequate light alloy for the rotor facilitates the use of a configuration defining a relatively high ratio R/e.

The seal groove(s) 68 of the outer body 12 are positioned to be radially outside the path of the eccentric member 36 of the shaft 38, and as such in a particular embodiment have a larger diameter when compared to oil seal grooves of a similar engine having the oil seals provided in the rotor. In a particular embodiment, this allows for the scavenging opening 62 to be significantly larger than that of a similar engine having the oil seals provided in the rotor, which may allow for oil pressure and as such load on the oil seals to be reduced. In a particular embodiment, this also allows for the land face 92 (see FIG. 3) provided on the inner surface 15 of the end wall 14 for abutment against the rotor 24 for axial alignment thereof to be larger than that of a similar engine having the oil seals provided in the rotor.

The above description is meant to be exemplary only, and one skilled in the art will recognize that changes may be made to the embodiments described without departing from the scope of the invention disclosed. Modifications which fall within the scope of the present invention will be apparent to those skilled in the art, in light of a review of this disclosure, and such modifications are intended to fall within the appended claims.

The invention claimed is:

1. A stator for a rotary internal combustion engine, the stator comprising:

a body having two axially spaced apart end walls and a peripheral wall extending between the end walls, with inner surfaces of the end walls and of the peripheral wall enclosing an internal cavity configured for receiving a rotor of the rotary internal combustion engine, the body further having an axial central bore defined therethrough and through the end walls, the central bore configured for receiving a shaft of the rotor, each end wall having a scavenging cavity defined therein in fluid communication with the internal cavity through a respective scavenging opening extending through the inner surface thereof, each of the end walls having at least one annular oil seal groove defined in the inner surface thereof concentric with the central bore and located radially outwardly of the scavenging opening with respect to the axial central bore; and at least one annular oil seal received in each groove and protruding from the end wall into the internal cavity, each seal being biased axially away from the end wall.

2. The stator as defined in claim 1, wherein the internal cavity has an epitrochoid shape defining two lobes.

3. The stator as defined in claim 1, wherein the at least one annular oil seal received in each groove includes first and second concentric seals having different diameters.

4. The stator as defined in claim 3, wherein the inner surface of each end wall has a single oil seal groove defined therein receiving the first and second seals with the first seal having a smaller diameter than that of the second seal, the first seal having an axial opening defined therethrough and an axially extending lip located radially outwardly of the axial opening, a first fluid communication between the groove and the scavenging cavity of the end wall being defined through the axial opening of the first seal and a second fluid communication between the groove and the scavenging cavity of the end wall being defined between the first and second seals.

5. The stator as defined in claim 1, wherein each seal is biased away from the end wall by a respective spring member extending across a fluid communication between the groove and the scavenging cavity.

6. The stator as defined in claim 1, wherein the at least one annular oil seal received in each groove includes a wiper seal having a first lip and a second lip located radially outwardly of the first lip, the second lip extending further away from the end wall than the first lip and having a radial contact surface angled with respect to a radial direction of the internal cavity.

7. The stator as defined in claim 6, wherein the at least one annular oil seal received in each groove further includes an additional oil and gas seal concentric with and having a larger diameter than that of the wiper seal.

8. The stator as defined in claim 7, wherein the additional oil and gas seal includes a seal ring having an annular opening defined in a radially outward surface thereof and a compressible sealing member received in the annular opening and protruding radially outwardly therefrom, the additional oil and gas seal being biased axially away from the end wall and radially outward with the compressible sealing member being in sealing engagement with a surface of the end wall adjacent the inner surface thereof.

9. A rotary internal combustion engine comprising:

an outer body having two axially spaced apart end walls and a peripheral wall extending between the end walls, with inner surfaces of the end walls and of the peripheral wall enclosing an internal cavity, the outer body having an axial central bore defined therethrough and through the end walls rotationally receiving a shaft therein;

a rotor body received in the internal cavity, the rotor body having two axially spaced apart end faces each extending in proximity of the inner surface of a respective one of the end walls, and a peripheral face extending between the end faces and defining circumferentially spaced apex portions, the rotor body being engaged to an eccentric member of the shaft to rotate within the cavity with each of the apex portions remaining adjacent the inner surface of the peripheral wall;

each of the end walls of the outer body having a scavenging cavity defined therein in fluid communication with the internal cavity through a respective scavenging opening extending through the inner surface thereof, each of the end walls having at least one annular oil seal groove defined in the inner surface thereof concentric with the central bore, the at least one annular seal groove located radially outwardly of the scavenging opening with respect to the axial central bore, the eccentric member defining a path on the end walls of the outer body during rotation, the at least one annular seal groove located radially outwardly of the path of the eccentric member with respect to the axial central bore; and at least one annular seal received in each seal groove and sealingly engaged with an adjacent one of the end faces of the rotor body, each seal being axially biased against the adjacent one of the end faces.

10. The engine as defined in claim 9, wherein the internal cavity of the outer body has an epitrochoid shape defining two lobes and the circumferentially spaced apex portions defined by the peripheral face of the rotor body includes three apex portions.

11. The engine as defined in claim 9, wherein a ratio R/e of the engine is at least 7, with R corresponding to a radius of the rotor body defined as a radial distance from a central axis of the rotor body to a tip of one of the apex portions and e corresponding to an eccentricity of the rotor body defined as a radial distance between a central axis of the shaft and a central axis of the eccentric member.

12. The engine as defined in claim 11, wherein the ratio R/e of the engine is at least 7.5.

13. The engine as defined in claim 11, wherein the rotor body is made of titanium.

14. The engine as defined in claim 9, wherein each seal is biased against the adjacent one of the end faces by a respective spring member extending across a communication between the seal groove and the scavenging cavity.

15. The engine as defined in claim 9, wherein the at least one annular seal received in each seal groove includes first and second concentric seals having different diameters.

16. The engine as defined in claim 15, wherein the inner surface of each end wall has a single oil seal groove defined therein receiving the first and second seals with the first seal having a smaller diameter than that of the second seal, the first seal having an axial opening defined therethrough and an axially extending lip located radially outwardly of the axial opening, a first fluid communication between the groove and the scavenging cavity of the end wall being defined through the axial opening of the first seal and a second fluid communication between the groove and the scavenging cavity of the end wall being defined between the first and second seals.

17. The engine as defined in claim 9, wherein the at least one annular oil seal received in each groove includes a wiper seal having a first lip and a second lip located radially outwardly of the first lip, the second lip extending further away from the end wall than the first lip and having a radial contact surface angled with respect to the adjacent one of the end faces and in sealing engagement with the adjacent one of the end faces, the first lip extending spaced apart from the adjacent one of the end faces.

18. The engine as defined in claim 17, wherein the at least one annular oil seal received in each groove further includes an additional oil and gas seal concentric with and having a larger diameter than that of the wiper seal.

19. The engine as defined in claim 18, wherein the additional oil and gas seal includes a seal ring having an annular opening defined in a radially outward surface thereof and a compressible sealing member received in the annular opening and protruding radially outwardly therefrom, the additional oil and gas seal being biased axially in sealing engagement with the adjacent one of the end faces and being biased radially outwardly with the sealing member in sealing engagement with a surface of the end wall adjacent the inner surface thereof.

20. A method of limiting radially outwardly directed oil leaks between a rotor body of a rotary engine and an outer body of the engine, the method comprising:

rotating the rotor body within the outer body while moving a central axis of the rotor body;

blocking a radially outwardly directed flow of oil by scraping a respective annular wiper seal extending from an inner surface of each of two end walls of the outer body against a respective one of two rotating end faces of the rotor body, the two end walls of the outer body being axially spaced apart, the two end faces of the rotor body being axially spaced apart;

directing the oil through a scavenging opening defined in the inner surface of the end wall and located radially inwardly of the wiper seal; and scavenging the oil in a scavenging cavity of the end wall communicating with the scavenging opening.

21. The method as defined in claim 20, further comprising blocking a remaining radially outwardly directed flow of oil flowing radially outwardly of the wiper seal by sealingly engaging an additional annular seal with the rotating end face of the rotor body.

22. The method as defined in claim 21, further comprising limiting radially inwardly directed gas leaks between the end face and the end wall by sealingly engaging the additional annular seal with a surface of the end wall adjacent the inner surface thereof.

* * * * *